US009498978B2

(12) United States Patent
Hobo et al.

(10) Patent No.: US 9,498,978 B2
(45) Date of Patent: Nov. 22, 2016

(54) CONVEYOR DEVICE AND INKJET RECORDING APPARATUS

(71) Applicant: KYOCERA Document Solutions Inc., Osaka-shi (JP)

(72) Inventors: Jumpei Hobo, Osaka (JP); Takeshi Watanabe, Osaka (JP); Hidenori Takenaka, Osaka (JP); Tomohisa Soda, Oasaka (JP); Masami Fujihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/748,086

(22) Filed: Jun. 23, 2015

(65) Prior Publication Data

US 2015/0375533 A1 Dec. 31, 2015

(30) Foreign Application Priority Data

Jun. 27, 2014 (JP) ..... 2014-133098

(51) Int. Cl.
*B41J 2/01* (2006.01)
*B41J 11/00* (2006.01)

(52) U.S. Cl.
CPC ..... *B41J 11/0085* (2013.01); *B41J 11/007* (2013.01)

(58) Field of Classification Search
USPC ..... 347/104; 400/611
See application file for complete search history.

(56) References Cited

U.S. PATENT DOCUMENTS

| | | | | |
|---|---|---|---|---|
| 6,695,503 | B1 * | 2/2004 | Buxton et al. | 400/634 |
| 7,354,147 | B2 * | 4/2008 | Beehler | 347/104 |
| 8,038,151 | B2 * | 10/2011 | Fukui | B41J 11/0085 101/389.1 |
| 8,308,156 | B2 | 11/2012 | Shinohara | |
| 8,308,288 | B2 * | 11/2012 | Fukui | 347/104 |
| 8,382,276 | B2 * | 2/2013 | Ikeda | B41J 2/155 347/101 |
| 8,388,246 | B2 * | 3/2013 | Spence et al. | 400/611 |
| 2005/0095046 | A1 * | 5/2005 | Beehler | 400/23 |
| 2010/0117293 | A1 | 5/2010 | Shinohara | |
| 2011/0064506 | A1 * | 3/2011 | Spence et al. | 400/611 |

FOREIGN PATENT DOCUMENTS

JP 2010-111507 A 5/2010

* cited by examiner

*Primary Examiner* — Matthew Luu
*Assistant Examiner* — Lily Kemathe
(74) *Attorney, Agent, or Firm* — Studebaker & Brackett PC

(57) ABSTRACT

A conveyor device includes a conveyor belt and a suction section. The conveyor belt conveys a recording medium. The suction section sucks on the recording medium via the conveyor belt. The suction section includes a guide member that supports the recording medium via the conveyor belt. The guide member has a plurality of grooves including at least one pair of grooves that are adjacent in a conveyance direction of the recording medium. Each of the grooves in the pair has an end adjacent to an end of the other groove in the pair. The adjacent ends of the respective grooves in the pair each have a portion overlapping with a portion of the adjacent end of the other groove in the pair (groove overlapping region) in a direction perpendicular to the conveyance direction.

14 Claims, 8 Drawing Sheets

CONVEYOR DEVICE AND INKJET RECORDING APPARATUS

INCORPORATION BY REFERENCE

The present application claims priority under 35 U.S.C. §119 to Japanese Patent Application No. 2014-133098 filed Jun. 27, 2014. The contents of this application are incorporated herein by reference in their entirety.

BACKGROUND

The present disclosure relates to conveyor devices and inkjet recording apparatuses.

A typical conveyor devices provided for mounting on an inkjet recording apparatus employs a conveyor belt for conveying a recording medium. Such a conveyor device utilizes negative pressure created by a fan for stable conveyance of a recording medium on the conveyor belt.

A conveyance mechanism (conveyor device) of a type includes a platen belt (conveyor belt), a platen plate (guide member) supporting the conveyor belt, and a suction fan (sucking device). A recording medium is sucked onto the conveyor belt by negative pressure exerted through recesses (grooves) and suction holes (through holes) in the guide member and sequentially through belt holes (suction holes) in the conveyor belt.

The grooves are independent of one another and arranged such that each groove is displaced from adjacent grooves in a direction perpendicular to the conveyance direction of a recording medium (a staggered arrangement, for example). As the conveyor belt travels, the number or the area of suction holes of the grooves located opposite to a given region on the conveyor belt increases or decreases. As a result, the suction force exerted on the recording medium through the individual grooves increases and decreases at different times relative to one another. Consequently, the suction air flow directed to the leading edge of a recording medium is dispersed, restricting local and excessive increase in the air flow. In this way, such a conveyor device restricts fluctuations (irregularities) in the suction force exerted on a recording medium being conveyed.

SUMMARY

According to a first aspect of the present disclosure, a conveyor device includes a conveyor belt and a suction section. The conveyor belt conveys a recording medium. The suction section sucks on the recording medium via the conveyor belt. The suction section includes a guide member. The guide member has a plurality of grooves, including at least one pair of grooves that are adjacent in a conveyance direction of the recording medium. Each of the grooves in the pair has an end adjacent to an end of the other groove in the pair. The adjacent ends of the respective grooves in the pair each have a portion overlapping with a portion of the adjacent end of the other groove in the pair in a direction perpendicular to the conveyance direction.

According to a second aspect of the present disclosure, an inkjet recording apparatus includes the conveyor device according to the first aspect of the present disclosure and a recording head. The recording head is disposed opposite to the conveyor device. The recording head includes an inkjet head configured to eject ink.

DETAILED DESCRIPTION

Figure 1:
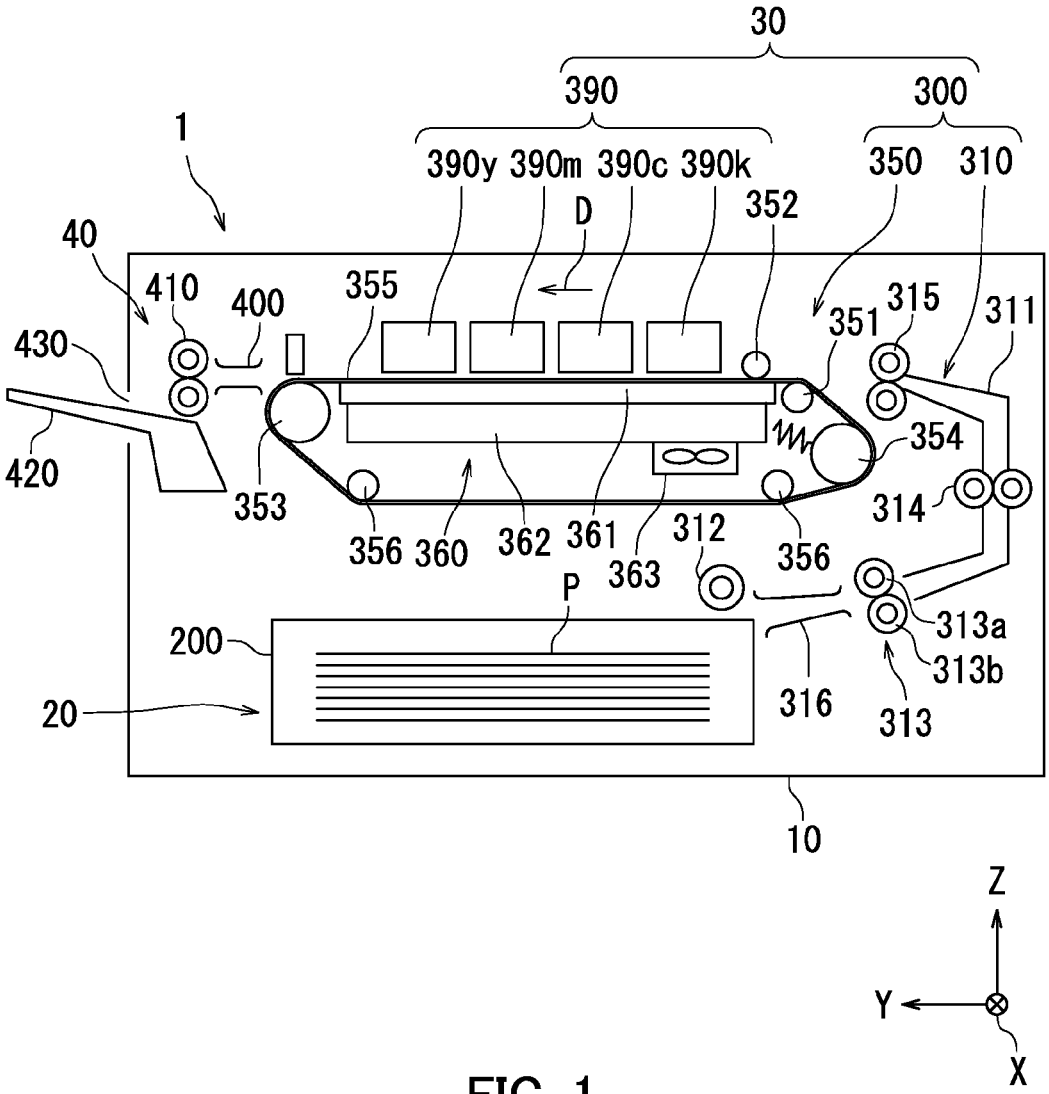
FIG. 1 illustrates the configuration of an inkjet recording apparatus that includes a conveyor device according to embodiments of the present disclosure.

Hereinafter, embodiments of the present disclosure will be described with reference to the accompanying drawings. In the figures of the accompanying drawings, the like reference numerals refer to similar elements, and explanation thereof is not repeated.

(Configuration of Inkjet Recording Apparatus 1)

An inkjet recording apparatus 1 will be described with reference to FIG. 1. FIG. 1 illustrates the configuration of an inkjet recording apparatus 1 that includes a conveyor device 300 according to Embodiment 1 of the present disclosure. The inkjet recording apparatus 1 includes a housing 10, a paper feed section 20 disposed in a lower location in the housing 10, an ink-jet image forming section 30, and a paper ejecting section 40.

The paper feed section 20 includes a paper feed cassette 200. The paper feed cassette 200 is detachably mounted in the housing 10. A plurality of sheets of recording medium P are stacked and loaded in the paper feed cassette 200. The recording medium P is paper such as plain paper, recycled paper, thin paper, or thick paper, for example.

The image forming section 30 includes the conveyor device 300 and a recording head 390. The conveyor device 300 includes a first paper conveyance section 310 and a second paper conveyance section 350 that is disposed opposite to the recording head 390. The second paper conveyance section 350 is located between the first paper conveyance section 310 and the paper ejecting section 40 in a conveyance direction D of the recording medium P. The image forming section 30 may include a drier (not shown). The drier dries ink droplets ejected onto the recording medium P.

The first paper conveyance section 310 has a paper conveyance path 311 extending substantially in a C shape. The first paper conveyance section 310 includes a paper feed roller 312 disposed above one end of the paper feed cassette 200, a pair of first conveyance rollers 313 disposed at an inlet of the paper conveyance path 311, a pair of second conveyance rollers 314 disposed at a midway portion of the paper conveyance path 311, a pair of registration rollers 315 disposed at an outlet of the paper conveyance path 311, and a pair of guide plates 316.

An X axis in FIG. 1 is parallel to a direction perpendicular to the conveyance direction D of the recording medium P. A Y axis is parallel to the conveyance direction D of the recording medium P in the second paper conveyance section 350. A Z axis is parallel to a direction perpendicular to a plane containing the conveyance direction D of the recording medium P in the second paper conveyance section 350. In Embodiment 1, the Z axis is a vertical direction. The X axis, the Y axis, and the Z axis are perpendicular to one another.

The pair of guide plates 316 is disposed between the paper feed roller 312 and the pair of first conveyance rollers 313. The paper feed roller 312 takes out the recording medium P in the paper feed cassette 200 sheet by sheet. The pair of guide plates 316 guides the recording medium P taken out by the paper feed roller 312 to the pair of first conveyance rollers 313.

The pair of first conveyance rollers 313 catches and conveys the recording medium P guided thereto by the pair of guide plates 316 toward the paper conveyance path 311. Specifically, the pair of first conveyance rollers 313 includes a feed roller 313*a* and a retard roller 313*b*. The feed roller 313*a* and the retard roller 313*b* are pressed against each other. The feed roller 313*a* rotates to convey the recording medium P in the conveyance direction D. The retard roller 313*b* is driven by the feed roller 313*a* to rotate when receiving one sheet of recording medium P. Upon receiving a plurality of sheets of recording medium P at the same time, on the other hand, the retard roller 313*b* stops or rotates in a direction opposite to a direction for conveying the recording medium P to separate a sheet(s) of recording medium P from a sheet of recording medium P in contact with the feed roller 313*a*. As a result, one sheet of recording medium P is fed by the feed roller 313*a*.

The pair of second conveyance rollers 314 catches and conveys the recording medium P conveyed thereto by the pair of first conveyance rollers 313 toward the pair of registration rollers 315. The pair of registration rollers 315 performs skew correction on the recording medium P that has arrived and stopped at the pair of registration rollers 315. The pair of registration rollers 315 temporarily holds the recording medium P to synchronize the conveyance of the paper P and printing, and then conveys the recording medium P to the second paper conveyance section 350 in a timed relationship with the printing.

The second paper conveyance section 350 includes a speed sensing roller 351, a placing roller 352, a drive roller 353, a tension roller 354, a pair of guide rollers 356, an endless conveyor belt 355, and a suction section 360. The conveyor belt 355 is wound around the speed sensing roller 351, the drive roller 353, the tension roller 354, and the pair of guide rollers 356 in a tensioned manner. The conveyor belt 355 has a conveyance surface on which the recording medium P is placed and a back surface opposite to the conveyance surface. Rotation axes of the rollers such as the drive roller 353 are parallel to the X axis. The conveyor belt 355 has a plurality of suction holes (not shown). Each of the suction holes penetrates the conveyor belt 355 from the conveyance surface through to the conveyance back surface.

The suction section 360 is disposed at the conveyance back surface of the conveyor belt 355 and opposite to the recording head 390 with the conveyor belt 355 therebetween. The suction section 360 includes a guide member 361, an air flow chamber 362, and at least one sucking device 363. The details will be given later of the guide member 361, the air flow chamber 362, and each sucking device 363 included in the suction section 360.

The speed sensing roller 351 is located upstream of the guide member 361 in terms of the conveyance direction D of the recording medium P. The speed sensing roller 351 includes a pulse plate (not shown). The speed sensing roller 351 rotates in contact with the conveyor belt 355. The rotational speed of the conveyor belt 355 is sensed by measuring the rotational speed of the pulse plate rotating integrally with the speed sensing roller 351. The speed sensing roller 351 restricts influence of meandering correction on the conveyor belt 355 at portions under the recording head 390.

The placing roller 352 is located at an upstream end of the guide member 361 in terms of the conveyance direction D of the recording medium P with the conveyor belt 355 therebetween. The placing roller 352 conveys the recording medium P in the conveyance direction D of the recording medium P while pressing the recording medium P against the conveyor belt 355 and the guide member 361. The placing roller 352 reduces curl of the recording medium P so that the suction section 360 can suck on the recording medium P entirely and uniformly. As a result, the contact between the recording medium P and the conveyor belt 355 is made closer.

It is preferable that the moment of inertia of the placing roller 352 is low and the placing roller 352 is light in order to reduce impact vibrations on the placing roller 352 when the recording medium P comes under the placing roller 352. For example, the placing roller 352 is formed from a hollow aluminum pipe or a hollow pipe including a plurality of ribs. Where the surface of the placing roller 352 is formed from aluminum, the surface is preferably subjected to alumite treatment in order to reduce abrasion of the surface of the placing roller 352. The alumite treatment refers to a treatment of coating the aluminum surface with a layer of aluminum oxide by electrochemically oxidizing the aluminum surface through electrolysis in acidic bath with the aluminum acting as the anode. The alumite treatment imparts electrical insulation to the placing roller 352. However, the surface of the placing roller 352 is not subjected to the alumite treatment where the placing roller 352 needs to be electrically conductive.

The speed of conveyance of the recording medium P by the pair of registration rollers 315 may be different from the speed of conveyance of the recording medium P by the conveyor belt 355. The conveyance speed difference can be overcome by applying pressing force from the placing roller 352 to the recording medium P on the conveyor belt 355 and thus causing flexing of the recording medium P between the pair of registration rollers 315 and the placing roller 352.

The drive roller 353 is disposed in a spaced relationship to the speed sensing roller 351 in terms of the conveyance direction D of the recording medium P. The speed sensing roller 351 and the drive roller 353 maintain the conveyor belt 355 on the guide member 361 flat. The drive roller 353 is in close contact with the conveyor belt 355 because of frictional force. Where the conveyor belt 355 is made from a resin such as polyimide (PI), polyamide-imide (PAI), polyvinylidene fluoride (PVDF), or polycarbonate (PC), for example, the surface of the drive roller 353 is preferably made from a rubbery material such as ethylene propylene diene monomer (EPDM) rubber, polyurethane resin, or nitrile rubber (NBR). Where the image forming section 30 forms an image on the recording medium P using an aqueous ink, in particular, it is preferable to form a layer of ethylene propylene diene monomer (EPDM) rubber on the drive roller 353 in order to prevent swelling of the rubbery material forming the surface of the drive roller 353.

Where the conveyor belt 355 includes a rubbery material such as ethylene propylene diene monomer (EPDM) rubber, the surface of the drive roller 353 may be made from a metal. Where the surface of the drive roller 353 is made from aluminum, the surface of the drive roller 353 is preferably subjected to alumite treatment in order to reduce abrasion of the surface of the drive roller 353. The alumite treatment imparts electrical insulation to the drive roller 353. However, the surface of the drive roller 353 is not subjected to the alumite treatment where the drive roller 353 needs to be electrically conductive. Where the drive roller 353 is in electrical communication with the conveyor belt 355, reduction in the accuracy of ink landing is restricted by electrically grounding the conveyor belt 355. In this case, the rubbery material included in the conveyor belt 355 is given electrical conductivity.

The drive roller 353 is driven by a motor (not shown) to rotate and cause the conveyor belt 355 to rotate counterclockwise. If the speed of the conveyor belt 355 is non-constant, non-constant speed correction control is exercised on the conveyor belt 355. The non-constant speed correction control is exercised to correct the non-constant rotation speed of the conveyor belt 355 so that the rotation speed of the conveyor belt 355 is constant. It is preferable that the moment of inertia of the drive roller 353 is low and the drive roller 353 is light for the non-constant speed correction control. For example, the drive roller 353 is made from a hollow aluminum pipe or a hollow pipe including a plurality of ribs. In the absence of the non-constant speed correction control, on the other hand, it is preferable that the drive roller 353 is heavy in order to stabilize the rotation of the drive roller 353 by the flywheel effect due to the inertia of the drive roller 353. In this case, the drive roller 353 is a solid roller made from a metal.

The tension roller 354 is disposed upstream of the guide member 361 in terms of the running direction of the conveyor belt 355. The tension roller 354 tensions the conveyor belt 355 in order to prevent flexing of the conveyor belt 355. Shifting the position of the tension roller 354 with respect to one end thereof enables automatic correction of meandering of the conveyor belt 355.

The conveyor belt 355 conveys the recording medium P sucked on the conveyor belt 355. The conveyor belt 355 is preferably made from polyamide-imide (PAI) or polyimide (PI), for example. Such materials prevent the conveyor belt 355 from having uneven thickness.

The pair of guide rollers 356 is disposed under the suction section 360. The pair of guide rollers 356 is fixed, maintaining a space defined by the internal peripheral surface (conveyance back surface) of the conveyor belt 355. Of the pair of guide rollers 356, a guide roller 356 that is closer to the drive roller 353 maintains the degree to which the conveyor belt 355 is wound around the drive roller 353. Of the pair of guide rollers 356, the other guide roller 356 that is closer to the tension roller 354 maintains the degree to which the conveyor belt 355 is wound around the tension roller 354 for stable correction of meandering of the conveyor belt 355.

Hereinafter, the guide member 361, the air flow chamber 362, and the sucking device 363 included in the suction section 360 will be described in detail.

The air flow chamber 362 has a hollow box-like shape opened at the top. That is, an opening is formed in the top of the air flow chamber 362. The guide member 361 is in communication with the air flow chamber 362. The guide member 361 covers (blocks) the top opening of the air flow chamber 362. The guide member 361 supports the recording medium P via the conveyor belt 355.

The sucking device 363 is in communication with the air flow chamber 362 and draws the air in the air flow chamber 362 to create negative pressure within the air flow chamber 362. As a result, the recording medium P is sucked toward the top of the air flow chamber 362 through the conveyor belt 355 and the guide member 361. It should be noted here that negative pressure refers to pressure lower than reference pressure.

The reference pressure referred to in the present specification is atmospheric pressure. Negative pressure $P_N$ is an absolute value of $(P_A-P_R)$, wherein "$P_A$" represents the absolute pressure and "$P_R$" represents the reference pressure $(P_N=|P_A-P_R|)$. The absolute pressure is pressure based on the absolute vacuum of 0. The air flow chamber 362 functions as a decompression chamber.

The recording head 390 includes one or more inkjet heads 390*k*, one or more inkjet heads 390*c*, one or more inkjet heads 390*m*, and one or more inkjet heads 390*y*. Each of the inkjet heads 390*k*, 390*c*, 390*m*, and 390*y* ejects ink.

The paper ejecting section 40 includes a pair of conveyance guides 400, a pair of ejection rollers 410, and an exit tray 420. The pair of conveyance guide 400 is located downstream of the second paper conveyance section 350 in terms of the conveyance direction D of the recording medium P. The exit tray 420 is fixed to the housing 10 and projected outward from an exit port 430 formed in the housing 10.

The pair of conveyance guides 400 guides the recording medium P being conveyed from the conveyor belt 355 to the pair of ejection rollers 410. The recording medium P that has passed through the pair of conveyance guides 400 is conveyed by the pair of ejection rollers 410 to the exit port 430 and ejected onto the exit tray 420 through the exit port 430.

Embodiment 1

Basic Structure

Figure 2A:
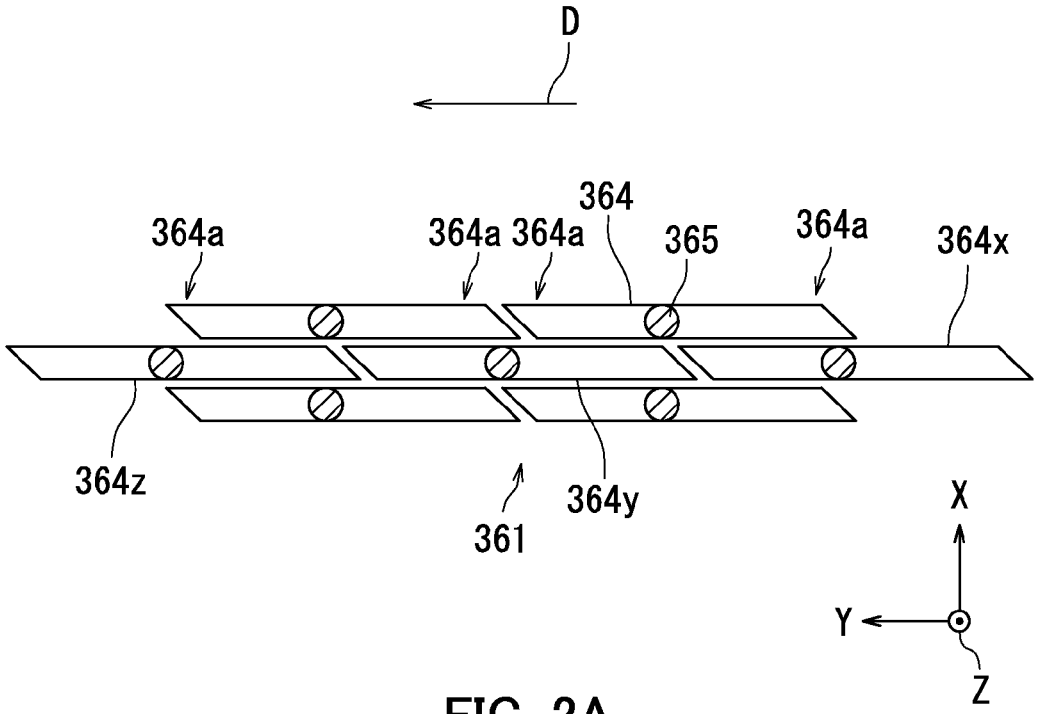
FIG. 2A is a plan view of a guide member of a conveyor device according to Embodiment 1 of the present disclosure.

The basic structure of the conveyor device 300 according to Embodiment 1 of the present disclosure will be described with reference to FIGS. 1, 2A, and 2B. FIG. 2A is a plan view of the guide member 361.

As shown in FIG. 2A, the guide member 361 has a plurality of grooves 364. More specifically, each of the grooves 364 is elongated in the conveyance direction D of the recording medium P on the guide member 361 (hereinafter, the direction is referred to as a "Y direction"). Each groove 364 measures 54 mm in the Y direction, and 6 mm in a direction perpendicular to the Y direction (hereinafter, the perpendicular direction is referred to as a "X direction"). The grooves 364 are in a staggered arrangement in the X direction as well as in the Y direction. Each of the grooves 364 has a through hole 365. The through hole 365 measures 6 mm in diameter. The through hole 365 may be located in one of the two opposite ends of the groove 364 or in a central portion of the groove 364. In one example, the through holes 365 of the respective grooves 364 are in a staggered arrangement in the X direction as well as in the Y direction.

The plurality of grooves 364 include at least one pair of grooves 364 that are adjacent to each other in the Y direction. Each of the grooves 364 in the pair has an end 364*a* adjacent to an end 364*a* of the other groove 364 in the pair. More specifically, among the plurality of grooves 364, a pair of grooves 364 adjacent to each other in the Y direction are two grooves 364 located in succession in the Y direction and thus one of the two grooves 364 is located upstream of the other groove 364. In the pair of grooves 364, a downstream end 364*a* of the upstream groove 364 (one of two opposite ends 364*a* of the upstream groove 364 that is located downstream of the other) has a portion overlapping with a portion of an upstream end 364*a* of the downstream groove 364 (one of two opposite ends 364*a* of the downstream groove 364 that is located upstream of the other) in the X direction.

In a similar manner to the above, the plurality of grooves 364 may include three or more grooves 364 located in succession so as to be adjacent to one another in the Y direction (for example, a first groove 364*x*, a second groove 364*y*, and a third groove 364*z* in order from an upstream location to a downstream location in the Y direction). Among the three or more grooves 364, one groove 364 (the second groove 364*y*) is adjacent at its upstream end 364*a* to the downstream end 364*a* of the groove 364 (the first groove 364*x*) that is immediately upstream of the one groove 364, whereas one groove 364 (the second groove 364*y*) is adjacent at its downstream end 364*a* to the upstream end 364*a* of the groove 364 (the third groove 364*z*) that is immediately downstream of the one groove 364.

Figure 2B:
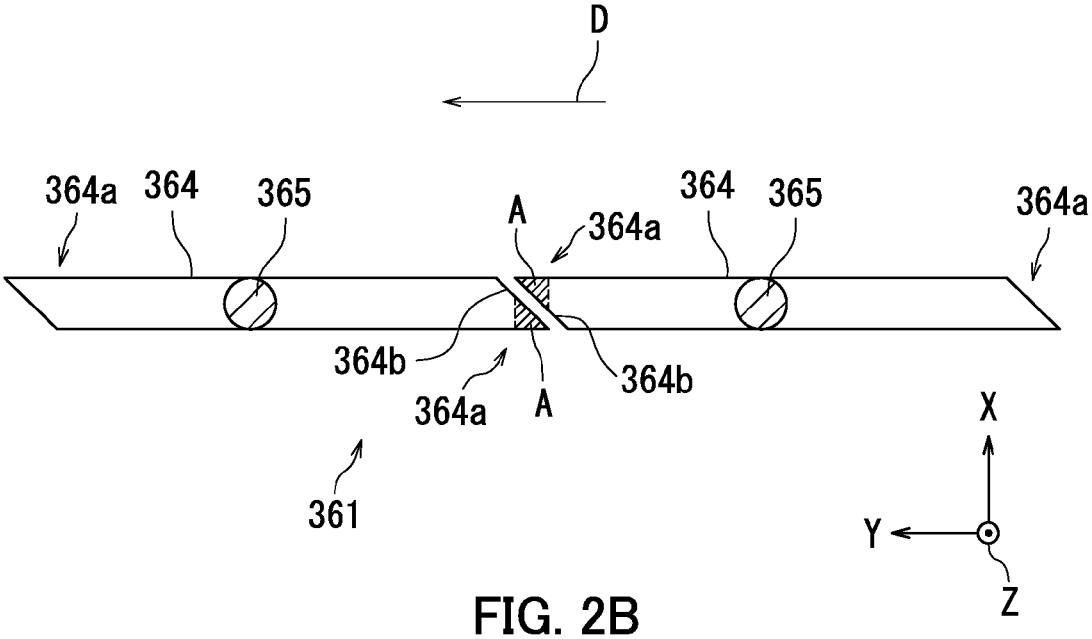
FIG. 2B is a plan view of a pair of adjacent grooves of the conveyor device according to Embodiment 1 of the present disclosure.

FIG. 2B is a plan view of the pair of adjacent grooves 364. As shown in FIG. 2B, the adjacent ends 364*a* of the respective grooves 364 in the pair each have an end face 364*b* such that end faces 364*b* of the respective grooves 364 are opposite to each other. The end faces 364*b* are both inclined with respect to the X direction. The adjacent ends 364*a* of the respective grooves 364 in the pair each have a portion overlapping with a portion of the adjacent end 364*a* of the other groove 364 in the pair in the X direction. More specifically, the end 364*a* of each groove 364 is adjacent to the end 364*a* of another groove 364 in the X direction. In one example, each groove 364 having such an end 364*a* is in a parallelogram shape. Hereinafter, a region of the guide member 361 where two adjacent ends 364*a* overlap with each other in the X direction is referred to as a "groove overlapping region A". In the groove overlapping region A, both the grooves 364 in the pair are open toward the back surface of the conveyor belt 355. In a region other than the groove overlapping region A, only one of the grooves 364 in the pair is open toward the back surface of the conveyor belt 355. When seen in the X direction, the adjacent ends 364*a* of the respective grooves 364 in the pair overlap with each other in the groove overlapping region A.

Upon actuation of the sucking device 363 with the recording medium P on the conveyance surface of the conveyor belt 355, negative pressure is created in the air flow chamber 362 (see FIG. 1). The sucking device 363 is a fan. The negative pressure acts on the recording medium P through the through holes 365 and the grooves 364 of the guide member 361, and sequentially through the suction holes of the conveyor belt 355. The conveyor belt 355 rotates to convey the recording medium P in the Y direction. The conveyor belt 355 measures 100 μm in thickness. Each suction hole in the conveyor belt 355 measures 2 mm.

As described above with reference to FIGS. 1, 2A, and 2B, the guide member 361 is configured such that each end 364*a* is adjacent to another end 364*a* in a direction perpendicular to the Y direction (in the X direction). Consequently, no interruption of sucking occurs when the recording medium P passes through a location corresponding to the gap between adjacent ends 346*a*. This is effective to prevent fluctuations in the suction force exerted through the suction holes of the conveyor belt 355 when the recording medium P passes a location corresponding to the gap between adjacent ends 364 as the conveyor belt 355 runs. Therefore, the conveyor device 300 can stably convey the recording medium P.

The end faces 364*b* of the respective adjacent ends 364 are preferably parallel to each other. The parallel end faces 364*b* allow the adjacent ends 364*a* to be located closer to each other as compared with non-parallel ends faces. Consequently, in each groove overlapping region A, an area in which the grooves 364 are open toward the back surface of the conveyor belt 355 increases, thereby increasing the suction force exerted on the recording medium P. As a result, fluctuations in the suction force of the conveyor belt 355 can be further reduced. In addition, the above configuration of the grooves 364 reduces the area of contact between the back surface of the conveyor belt 355 and the upper surface of the guide member 361, which is effective to reduce abrasion of the conveyor belt 355 and thus improve the durability of the conveyor belt 355.

[Variation 1 of End 364*a*]

Figure 3A:
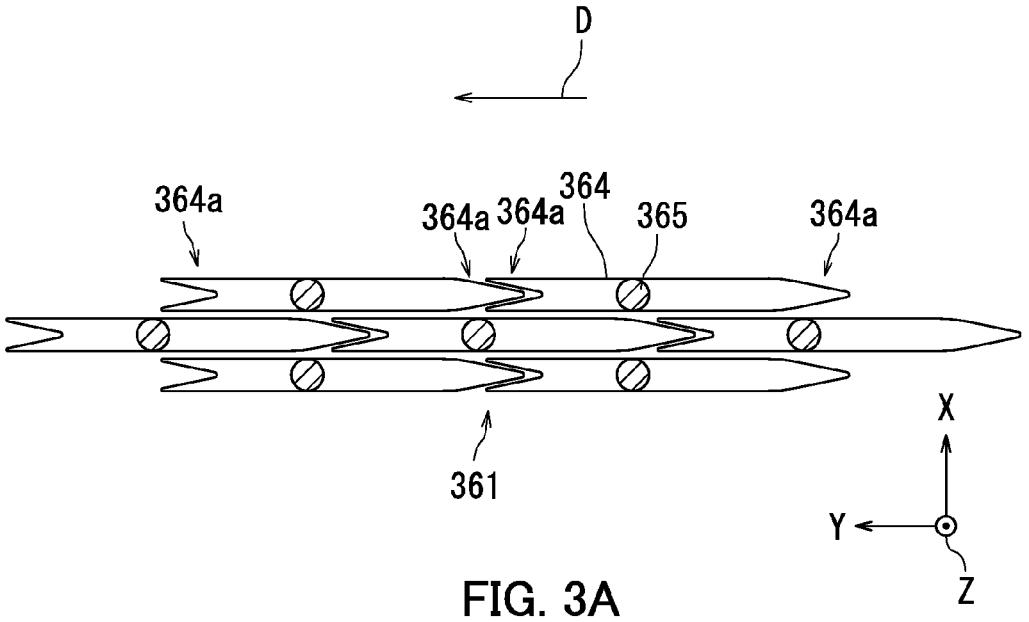
FIG. 3A is a plan view of a guide member of a conveyor device according to Variation 1 of Embodiment 1 of the present disclosure.
Figure 3B:
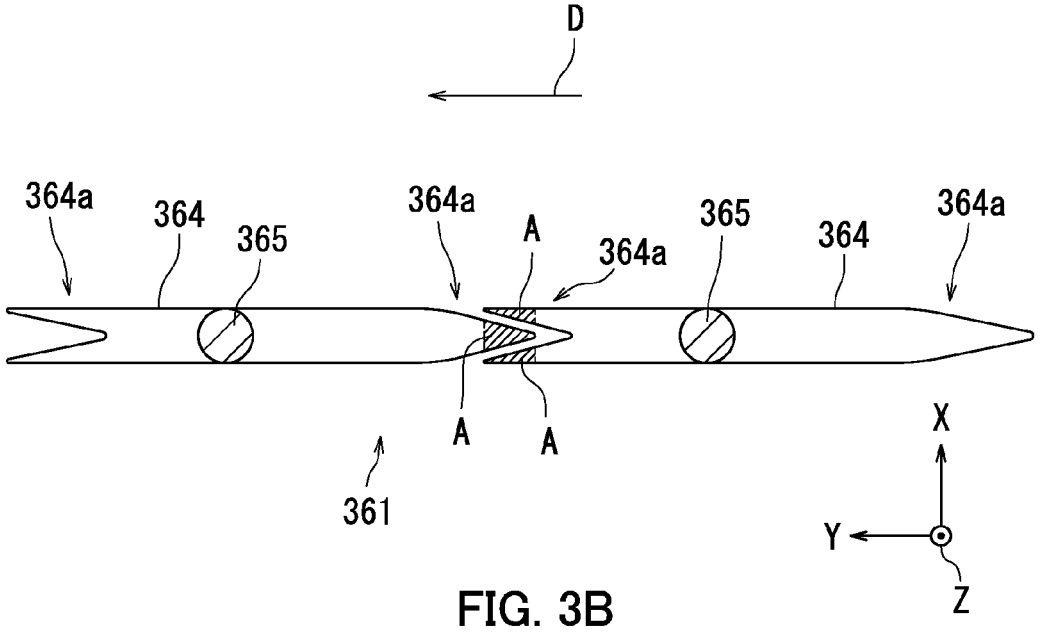
FIG. 3B is a plan view of the pair of adjacent grooves of the conveyor device according to Variation 1 of Embodiment 1 of the present disclosure.

With reference to FIGS. 3A and 3B, the ends 364*a* according to Variation 1 of Embodiment 1 are described. FIG. 3A is a plan view of the guide member 361. FIG. 3B is a plan view of the pair of adjacent grooves 364. The ends 364*a* according to Variation 1 are different from the ends 364*a* shown in FIGS. 2A and 2B in that at least one of the ends 364*a* has a two-pronged shape.

As shown in FIGS. 3A and 3B, at least one of two adjacent ends 364*a* in the pair has a two-pronged shape. More specifically, at least one of the two adjacent ends 364*a* (the upstream end 364*a*, for example) of the respective grooves 364 has a two-pronged shape in which two prongs protrude toward the other adjacent end (the downstream end 364*a*, for example). In one example, the shape of a two-prong end 364*a* resembles the shape of a two-pronged fork.

Preferably, the end 364*a* (the downstream end 364*a*, for example) that is adjacent to a two-pronged end 364*a* (the upstream end 364*a*, for example) has a shape conforming to the outline of the two prongs. In one example, an end 364 adjacent to a two-pronged end 364*a* has a shape of a diminishing taper toward a point between the two prongs of the two-prong end 364*a*.

As has been described with reference to FIGS. 3A and 3B, at least one of two adjacent ends 364*a* has a two-pronged shape. This allows the adjacent ends 364*a* to be arranged in nesting relation. With this arrangement, the difference in the suction force exerted through the adjacent ends 364 is reduced across each groove overlapping region A and thus fluctuations in the suction force are reduced.

By forming the other end 364*a* of the two adjacent ends 364*a* in a tapered shape, the adjacent ends 364*a* face each other along a longer horizontal length (the length in the X-Y plane). Consequently, the supporting points on the guide member 361 supporting the conveyor belt 355 increase to improve the flatness of the upper surface of the guide member 361. As a result, the conveyance capability of the conveyor belt 355 improves.

[Variation 2 of End 364*a*]

Figure 4A:
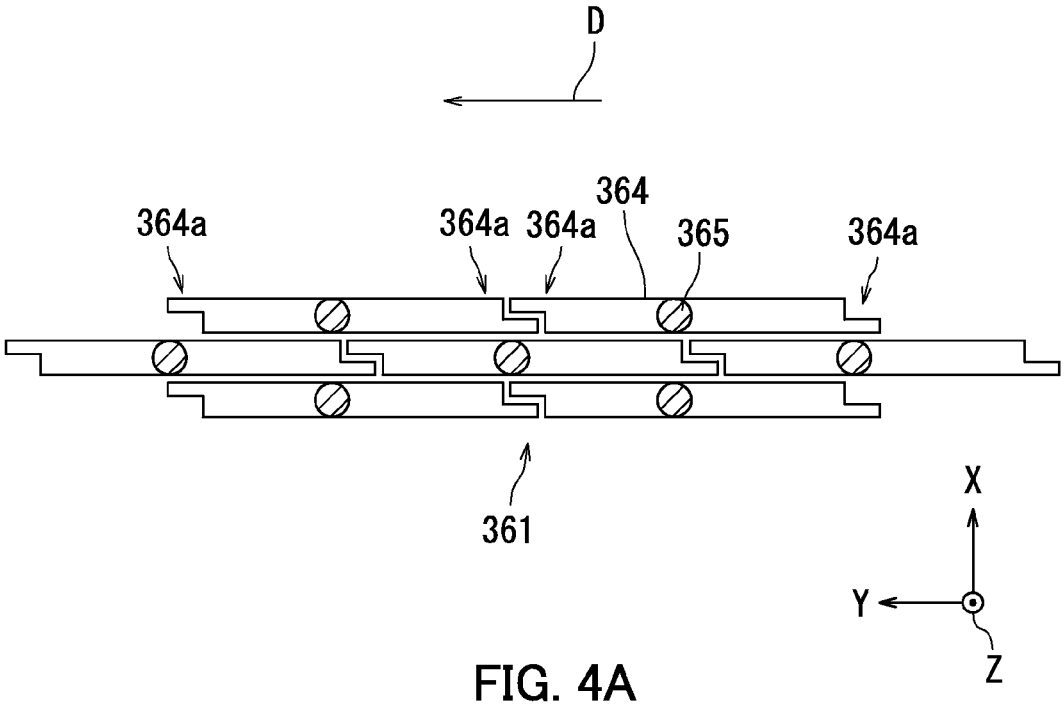
FIG. 4A is a plan view of a guide member of a conveyor device according to Variation 2 of Embodiment 1 of the present disclosure.
Figure 4B:
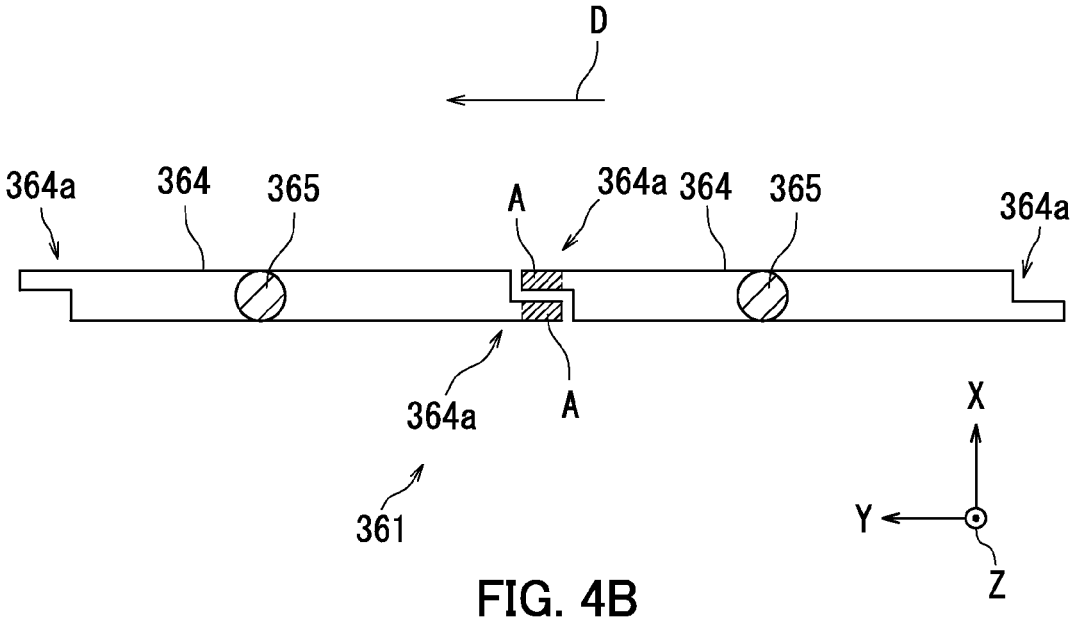
FIG. 4B is a plan view of the pair of adjacent grooves of the conveyor device according to Variation 2 of Embodiment 1 of the present disclosure.

With reference to FIGS. 4A and 4B, Variation 2 of the ends 364*a* according to Embodiment 1 is described. FIG. 4A is a plan view of the guide member 361. FIG. 4B is a plan view of the pair of adjacent grooves 364. The ends 364*a* according to Variation 2 is different from the ends 364*a* shown in FIGS. 2A and 2B or 3A and 3B in that at least one of the ends 364*a* has a stepped shape.

As shown in FIGS. 4A and 4B, at least one of two adjacent ends 364*a* has a stepped shape. More specifically, a stepped end 364*a* has a shape recessed to define a rectangular shoulder (two steps defining one shoulder, for example).

Preferably, the end 364*a* that is adjacent to a stepped end 364*a* has a shape conforming to the outline of the shoulder. In one example, the end 364*a* that is adjacent to an upstream end 364*a* being a stepped end is also a stepped end having a conforming shape.

As has been described with reference to FIGS. 4A and 4B, both the two adjacent ends 364*a* are formed to have a stepped shape. This configuration of the grooves 364 is advantages in that the adjacent ends 364*a* face each other along a longer horizontal length, in addition to that the shape of such an end 364*a* is simple. This configuration allows easy removable of contaminants (ink, paper dust, and other types of dust) collected on the end 364*a*, restricting such contaminants from interfering with air flow through the groove 364.

Embodiment 2

Figure 5:
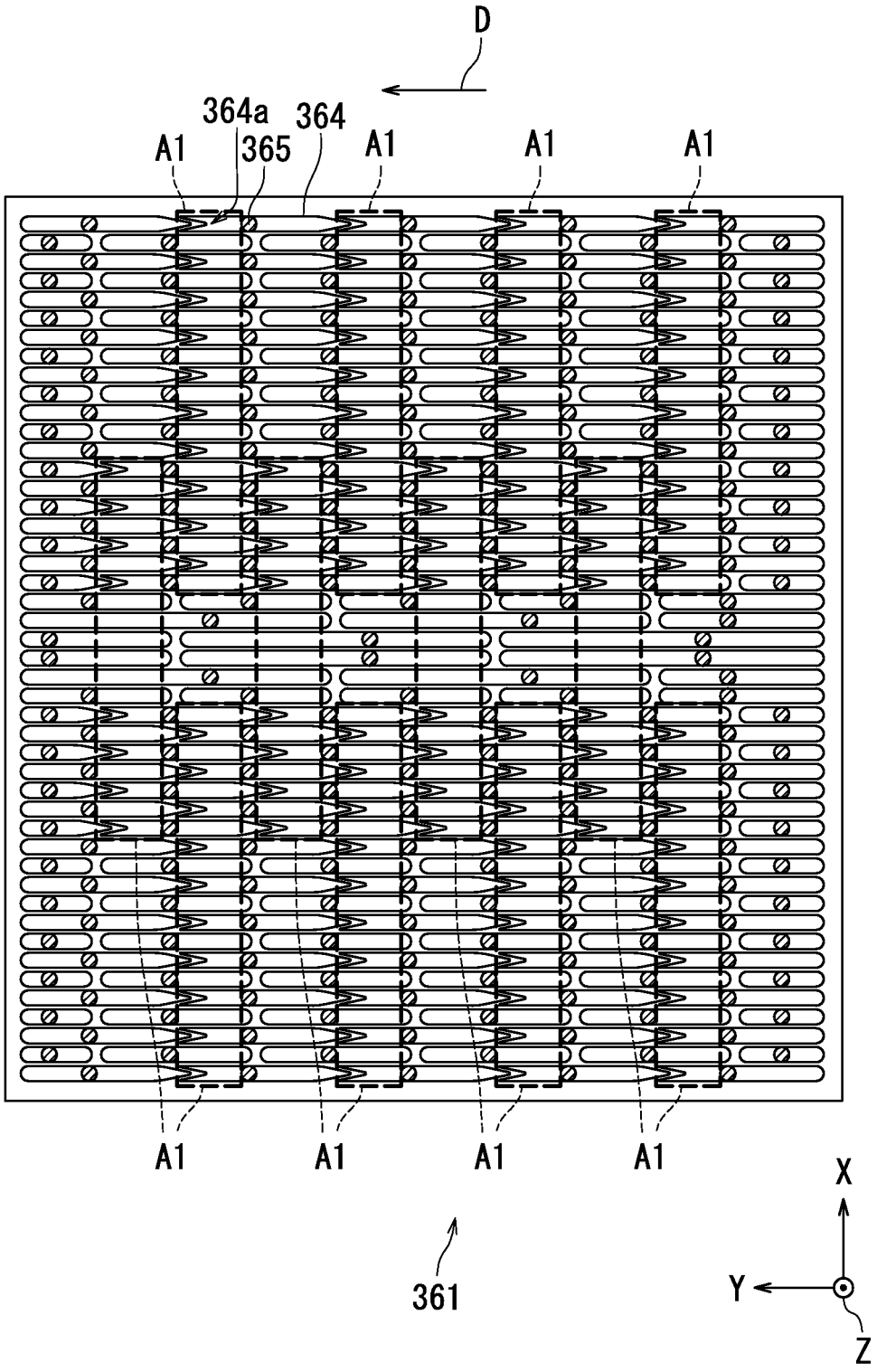
FIG. 5 is a plan view of a guide member of a conveyor device according to Embodiment 2 of the present disclosure.

The basic structure of a conveyor device 300 according to Embodiment 2 of the present disclosure will be described with reference to FIGS. 1 and 5. FIG. 5 is a plan view of the guide member 361.

In the conveyor device 300 according to Embodiment 2, the pair of grooves 364 is located opposite to a recording head 390. More specifically, the at least one pair of grooves 364 of the guide member 361 is located in a region A1 that is right under the recording head 390.

The following describes a reason for placing the pair of grooves 364 at a location opposite to the recording head 390 in the conveyor device 300 according to Embodiment 2. In a typical conveyor device, the suction section includes a guide member having a plurality of grooves and through hole across the entire region of the guide member. The configuration of the guide member included in the suction section is considered a factor that determines the degree of the unintended positional shift and coloristic shift of an image formed on the recording medium. The unintended positional shift and coloristic shift of an image is considered dependent on the accuracy of ink landing. The accuracy of ink landing is considered dependent on the accuracy of trajectory distance of ink and the conveyance speed of a recording medium. The ink trajectory distance refers to the distance between the recording head and the recording medium. To maintain the ink trajectory distance constant, the recording medium on the conveyor belt needs to be held flat without lifting.

In view of the above, it is necessary to suck on a recording medium to keep the recording medium from lifting, in addition to keeping the surface right under the recording head precisely flat. Therefore, the configuration of the guide member, which is located under the recording head and on which a recording medium is placed, is considered a factor that determines the accuracy of ink landing, and eventually the degree of the unintended positional shift and coloristic shift of an image.

In view of the above, the guide member 361 according to Embodiment 2 includes the pair of grooves 364 in the region A1 located opposite to the recording head 390. This configuration restricts lifting of the recording medium P in the region A1, which is effective to keep the ink trajectory distance constant and to reduce inaccurate ink landing. As a result, the unintended positional shift and coloristic shift of an image is reduced.

Embodiment 3

Figure 6:
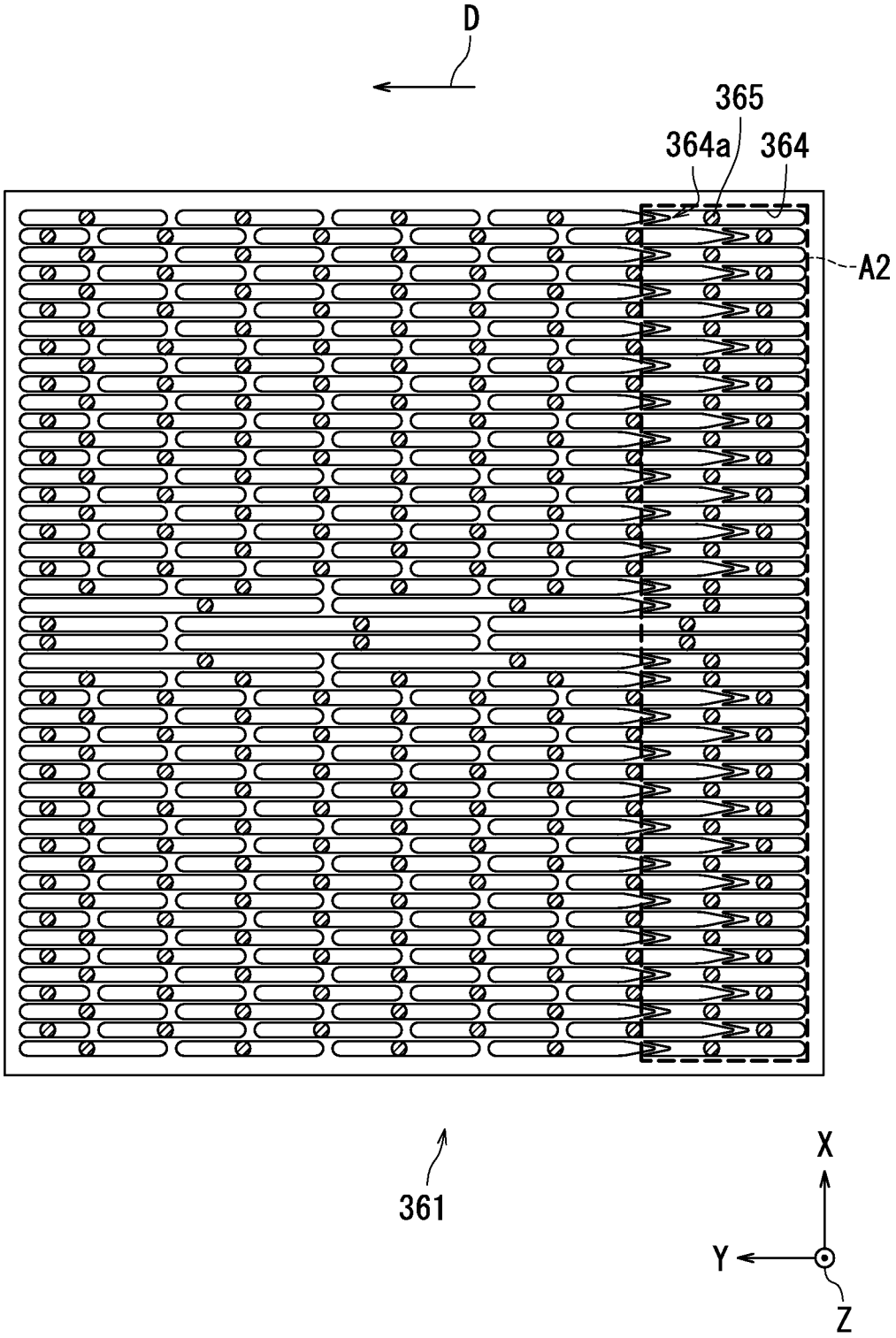
FIG. 6 is a plan view of a guide member of a conveyor device according to Embodiment 3 of the present disclosure.

The basic structure of a conveyor device 300 according to Embodiment 3 of the present disclosure will be described with reference to FIGS. 1 and 6. FIG. 6 is a plan view of the guide member 361. The guide member 361 of Embodiment 3 differs from Embodiment 2 in that the pair of grooves 364 is located in a most upstream region A2 of the guide member 361 in terms of the Y direction.

In the conveyor device 300 according to Embodiment 3, the guide member 361 has a plurality of grooves 364 including most upstream grooves 364 located at the upstream end of the guide member 361 in terms of the Y direction. The pair of grooves 364 is located in the most upstream region A2 in which the most upstream grooves 364 are located. The most upstream grooves 364 are located in the vicinity of the placing roller 352.

The following describes a reason for placing the pair of grooves 394 in the most upstream region A2 in the conveyor device 300 according to Embodiment 3. In a typical conveyor device, a recording medium conveyed by the first paper conveyance section is forwarded by the placing roller onto the conveyance surface of the conveyor belt. When the placing roller forwards the recording medium on the conveyor belt, the area of contact between the recording medium and the conveyor belt is small. Therefore, the force causing the recording medium to adhere to the conveyor belt (the suction force acting on the conveyor belt) is weak. As described above, lifting of the recording medium from the conveyor belt may occur, which may result in positional shift and coloristic shift of an image. Such unintended positional shift and coloristic shift of an image is likely to occur especially in the leading edge portion of the recording medium.

In view of the above, the guide member 361 according to Embodiment 3 includes the pair of grooves 364 in the most upstream region A2. This configuration restricts lifting of the recording medium P in the most upstream region A2, and thus restricts positional shift and coloristic shift of an image.

Embodiment 4

Figure 7:
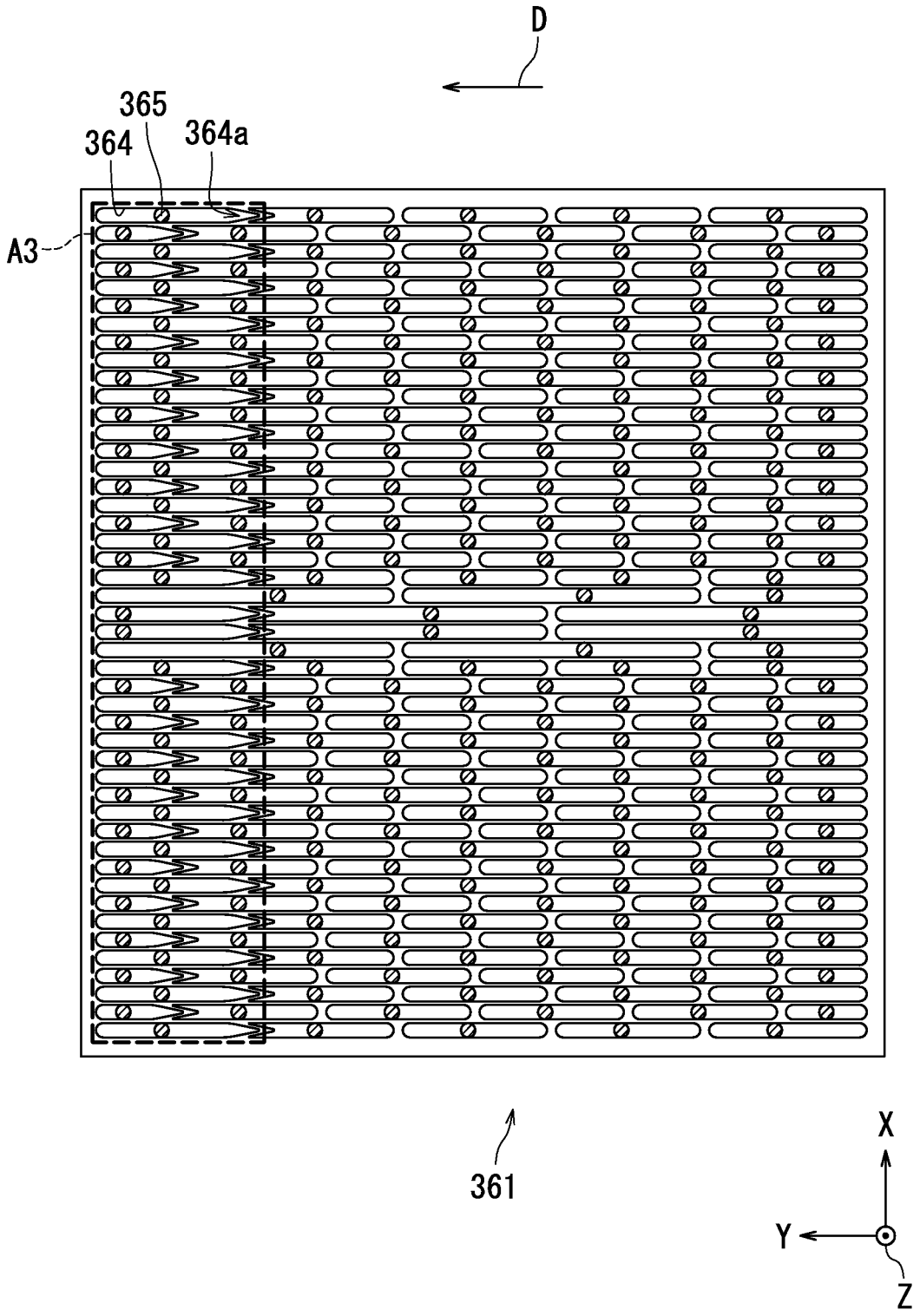
FIG. 7 is a plan view of a guide member of a conveyor device according to Embodiment 4 of the present disclosure.

The basic structure of a conveyor device 300 according to Embodiment 4 of the present disclosure will be described with reference to FIGS. 1 and 7. FIG. 7 is a plan view of the guide member 361. The guide member 361 of Embodiment 4 differs from Embodiments 2 and 3 in that the pair of grooves 364 is located in a most downstream region A3 in terms of the Y direction.

In the conveyor device 300 according to Embodiment 4, the guide member 361 has a plurality of grooves 364 including most downstream grooves 364 located at the downstream end of the guide member 361 in terms of the Y direction. The pair of grooves 364 is located in the most downstream region A3 in which the most downstream grooves 364 are located. The most downstream grooves 364 are located in the vicinity of the drive roller 353.

The following describes a reason for placing the pair of grooves 394 in the most downstream region A3 in the conveyor device 300 according to Embodiment 4. In a typical conveyor device, a recording medium conveyed by the conveyor belt is guided by the conveyance guide to the pair of ejection rollers. When the pair of ejection rollers pulls the recording medium in a downstream direction in terms of the conveyance direction, the area of contact between the recording medium and the conveyor belt is small. As described above, lifting of the recording medium from the conveyor belt may occur, which may result in unintended positional shift and coloristic shift of an image. Such unintended positional shift and coloristic shift of an image is likely to occur especially in the trailing edge portion of the recording medium.

In view of the above, the guide member 361 according to Embodiment 4 includes the pair of grooves 364 in the most downstream region A3. This configuration restricts lifting of the recording medium P in the most downstream region A3, and thus restricts unintended positional shift and coloristic shift of an image.

Embodiment 5

Figure 8:
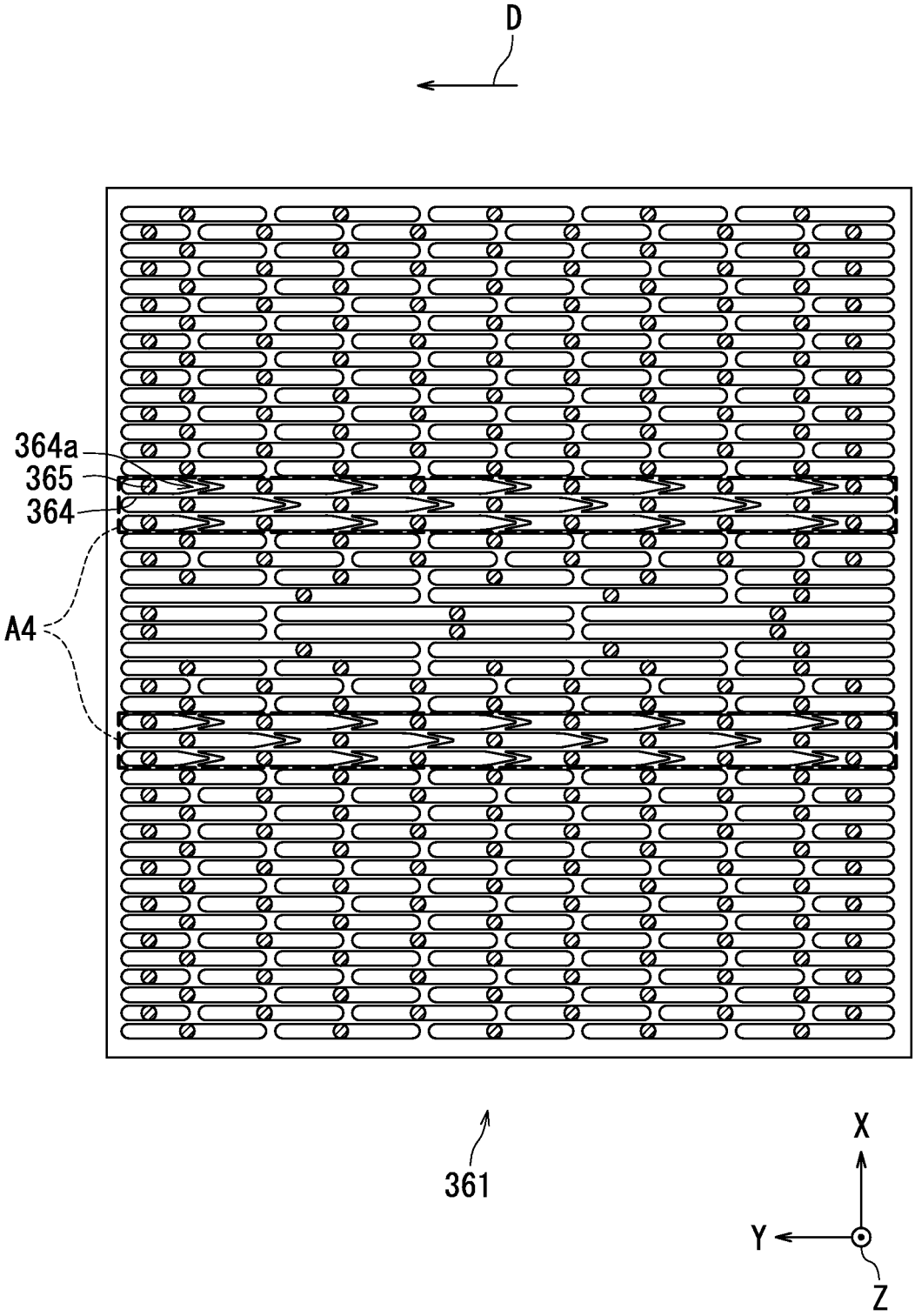
FIG. 8 is a plan view of a guide member of a conveyor device according to Embodiment 5 of the present disclosure.

The basic structure of a conveyor device 300 according to Embodiment 5 of the present disclosure will be described with reference to FIGS. 1 and 8. FIG. 8 is a plan view of the guide member 361. The guide member 361 of Embodiment 5 differs from Embodiments 2 to 4 in that the pair of grooves 364 is located in a region corresponding to where an edge that is parallel to the Y direction among the edges of the recording medium P passes.

In the conveyor device 300 according to Embodiment 5, the pair of grooves 364 is located in an edge-passing region A4. The edge-passing region A4 is a region of the guide member 361 and corresponds to where an edge that is parallel to the Y direction, among the edges of the recording medium P, passes. The edge-passing region A4 extends throughout the guide member 361 in the Y direction, from the upstream end to the downstream end of the guide member 361. When a sheet of the recording medium P is rectangle and the edges thereof parallel to each other in the Y direction both pass over the guide member 361, the number of edge-passing regions A4 is two. The number of the edge-passing regions A4 in the guide member 361 increases with the number of different sheet sizes of recording mediums P conveyable by the conveyor device 300.

The following describes a reason for placing the pair of grooves 394 in an edge-passing region A4 in the conveyor device 300 according to Embodiment 5. In a typical conveyor device, when a recording medium is conveyed on the conveyor belt, the suction force acting on the recording medium at portions near the parallel edges in the Y direction is weaker than at other portions because such portions receive a suction force through a fewer number of suction holes in the conveyor belt. Consequently, lifting (upward curling) may occur at such edge portions of the recording medium. This may result in positional shift and coloristic shift of an image in a manner described above. Especially, when the recording medium of a smallest conveyable size is conveyed, due to its small size, positional shift and coloristic shift of an image is more likely to occur due to lifting of portions of the recording medium P along the parallel edges in the Y direction.

In view of the above, the guide member 361 according to Embodiment 5 includes the pair of grooves 364 in an edge-passing region A4. This configuration restricts lifting (upward curling) of the recording medium P in each edge-passing region A4, and thus restricts positional shift and coloristic shift of an image.

Especially preferably, the pair of grooves 364 is located in a region corresponding to where a recording medium of a smallest conveyance size passes. This configuration restricts lifting (upward curling) of the recording medium P along either of the parallel edges in the Y direction despite that the suction force acting on the recording medium P is small due to its small size.

The above has described the embodiments with reference to the accompanying drawings (FIGS. 1 to 8). However, the present disclosure is not limited to the above-described embodiments and can be practiced in various ways (e.g., the following (1) to (4)) within the scope not departing from the gist of the present disclosure. The drawings are intended to illustrate mainly the components in a schematic manner to assist with understanding. The thickness, the length, the number, and so on of each component illustrated are not true to scale for diagrammatic purposes. The material, shape, dimensions, and so on of each component shown in the above-described embodiments are exemplary only and not particularly limited. Various alternations can be made thereto within the scope not substantially departing from the effect of the present disclosure.

(1) The sucking device 363 shown in FIG. 1 is a fan but may alternatively be a vacuum pump.

(2) As described with reference to FIGS. 2A and 2B, one groove 364 has one through hole 365 formed therein. Alternatively, a plurality of through holes 365 may be formed in one groove 364.

(3) With respect to the shapes of the ends 364*a* adjacent in a direction perpendicular to the Y direction shown in FIGS. 5 to 8, one of the ends 364*a* is has the shape of a two-prong fork and the other of the ends 364*a* has a tapered shape as described with reference to FIGS. 3A and 3B. Alternatively, the adjacent ends 364 may have shapes described with reference to FIGS. 2A and 2B or 4A and 4B.

(4) Embodiments 1 to 5 above each describe the conveyor device included in the inkjet recording apparatus 1. Alternatively, the conveyor device 300 may be mounted on another recording device, such as an electrographic image forming apparatus.

What is claimed is:

1. A conveyor device comprising:

a conveyor belt configured to convey a recording medium; and a suction section configured to suck on the recording medium via the conveyor belt, wherein the suction section includes a guide member configured to support the recording medium via the conveyor belt, the guide member has a plurality of grooves each extending in parallel to a conveyance direction of the recording medium, the plurality of grooves include at least one pair of grooves that are adjacent in the conveyance direction, the grooves in the pair have respective longitudinal axes substantially located on a single straight line extending in parallel to the conveyance direction, each of the grooves in the pair has an end adjacent to an end of the other groove in the pair, the adjacent ends of the respective grooves in the pair are located opposite to each other in the conveyance direction, and the adjacent ends of the respective grooves in the pair each have a portion overlapping with a portion of the adjacent end of the other groove in the pair in a direction perpendicular to the conveyance direction.

2. The conveyor device according to claim 1, wherein the adjacent ends of the respective grooves in the pair each have an end face, the end faces being parallel to each other.

3. The conveyor device according to claim 2, wherein the adjacent end of at least one of the grooves in the pair has a two-pronged shape.

4. The conveyor device according to claim 3, wherein the adjacent end of the other groove in the pair has a tapered shape.

5. The conveyor device according to claim 2, wherein the adjacent end of at least one of the grooves in the pair has a stepped shape.

6. The conveyor device according to claim 1, wherein the conveyor device is disposed opposite to a recording head such that the pair of grooves is opposite to the recording head.

7. The conveyor device according to claim 1, wherein the plurality of grooves include a most upstream groove located at an upstream end of the guide member in terms of the conveyance direction, and the pair of grooves is located in a most upstream region of the guide member, the most upstream region containing the most upstream groove.

8. The conveyor device according to claim 1, wherein the plurality of grooves include a most downstream groove located at a downstream end of the guide member in terms of the conveyance direction, and the pair of grooves is located in a most downstream region of the guide member, the most downstream region containing the most downstream groove.

9. The conveyor device according to claim 1, wherein the pair of grooves is located in an edge-passing region of the guide member, and the edge-passing region contains a region through which an edge that is parallel to the conveyance direction, among edges of the recording medium, passes.

10. An inkjet recording apparatus comprising:

the conveyor device according to claim 1; and a recording head disposed opposite to the conveyor device, wherein the recording head includes an inkjet head configured to eject ink.

11. The conveyor device according to claim 1, wherein a most downstream point of a groove among the pair of grooves that is located upstream in terms of the conveyance direction is located upstream of a most upstream point of a groove among the pair of grooves that is located downstream in terms of the conveyance direction.

12. The conveyor device according to claim 1, wherein the recording medium is a sheet of paper.

13. The conveyor device according to claim 1, wherein the adjacent ends of the respective grooves in the pair have respective inclined surfaces opposite to and substantially parallel to each other, and the inclined surfaces each incline with respect to the direction perpendicular to the conveyance direction.

14. The conveyor device according to claim 1, wherein one end of the adjacent ends of the respective grooves in the pair includes two protrusions, the two protrusions each protrude in the conveyance direction, the two protrusions are located with a space therebetween in the direction perpendicular to the conveyance direction, and the other end of the adjacent ends of the respective grooves in the pair includes a protrusion protruding in the space between the two protrusions.

* * * * *